US006397671B1

(12) United States Patent
Nishio et al.

(10) Patent No.: US 6,397,671 B1
(45) Date of Patent: Jun. 4, 2002

(54) SHEET DETECTING DEVICE

(75) Inventors: Goki Nishio; Yuji Ohashi; Hideki Chujo; Masashi Sugimoto; Takeshi Arihara; Koji Iesaki, all of Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/489,052

(22) Filed: Jan. 21, 2000

(30) Foreign Application Priority Data

Jan. 21, 1999 (JP) ..... 11-013257

(51) Int. Cl.[7] ..... B65H 7/12
(52) U.S. Cl. ..... 73/159; 271/263
(58) Field of Search ..... 73/159, 597; 271/263; 340/674, 675

(56) References Cited

U.S. PATENT DOCUMENTS

| | | | | |
|---|---|---|---|---|
| 4,066,969 A | * | 1/1978 | Pearce et al. | 340/674 |
| 4,368,438 A | * | 1/1983 | Stienstra | 73/159 |
| 4,446,735 A | * | 5/1984 | Weilacher | 73/159 |

FOREIGN PATENT DOCUMENTS

| | | |
|---|---|---|
| DE | 3620042 A1 | 1/1987 |
| DE | 42 27 052 C1 | 3/1994 |
| JP | 52-40379 | 3/1977 |
| JP | 3-75047 | 11/1991 |

* cited by examiner

*Primary Examiner*—John E. Chapman
(74) *Attorney, Agent, or Firm*—Foley & Lardner

(57) ABSTRACT

An ultrasonic wave that is transmitted from an ultrasonic-wave transmitter 1 is received by an ultrasonic-wave receiver 2, through a sheet 4. A reception signal is input to an extracting unit 19. The extracting unit compares its phase with a phase of a reference signal output from a reference-signal reproduction unit 18. It converts a phase difference therebetween into a signal having a level corresponding to the phase difference. The signal having a level corresponding to the phase difference is compared with a threshold value set in a threshold-value setter 20, by a comparator 21. When one sheet 4 is fed, the comparator 21 produces a signal of high level. When a doubles feeding occurs, it produces a signal of low level.

1 Claim, 6 Drawing Sheets

OSCILLATION SIGNAL
TIME

RECEPTION SIGNAL IN FACTORY BEFORE DELIVERED (NO SHEET IS PRESENT)
TIME
A0

RECEPTION SIGNAL IN FACTORY BEFORE DELIVERED (ONE SHEET IS PRESENT)
TIME
B0

RECEPTION SIGNAL AT THE TIME OF CALIBRATION (NO SHEET IS PRESENT)
TIME
A1

RECEPTION SIGNAL TO BE PREDICTED (ONE SHEET IS PRESENT)
TIME
B0
A1 - A0
B1

REFERENCE SIGNAL
TIME
B1

OSCILLATION SIGNAL
A
PHASE DIFFERENCE
TO BE PREDICTED

RECEIVER
DETECTING SIGNAL
E
REFERENCE SIGNAL
F

RECEIVER
DETECTING SIGNAL
R1
G1
H1
SELECTOR OUTPUT

RECEIVER
DETECTING SIGNAL
R2
G2
H2
SELECTOR OUTPUT

RECEIVER
DETECTING SIGNAL
R3
G3
H3
SELECTOR OUTPUT

RECEIVER
DETECTING SIGNAL
R4
SELECTOR OUTPUT
G4
H4

SHEET DETECTING DEVICE

BACKGROUND OF THE INVENTION

1. Field of the Invention

The present invention relates to a sheet detecting device, and more particularly to a sheet detecting device reliably detecting a feeding state that sheets are doubly fed.

2. Description of the Background Art

A scanner, a printer, a copying machine, a printing machine, an ATM (automated teller machine), or the like, has a mechanism in which a bundle of sheets, such as papers or bank notes, are separated into each single sheet, and each separated one is fed sheet by sheet. In such a feeding, though each of the single sheets should be to be fed sheet by sheet, a doubles feeding occurs in the case where two or more sheets are erroneously fed while being partially or entirely superimposed one on another. In the case of the doubles feeding, it is necessary to give a user an alarm of the doubles feeding. In view of the doubles feeding, a doubles detector for detecting the doubles feeding is provided in each of those machines.

From the standpoint of the detection principle, the doubles detectors are categorized into a doubles detector of a level type as disclosed in Japanese patent No. 1725105 and a doubles detector of a phase type as disclosed in JP-A-52-40379.

In the doubles detector of the level type, a transmitter for transmitting an ultrasonic wave and a receiver for receiving the ultrasonic wave are provided in a feeding path through which the sheets are fed. The receiver receives the ultrasonic wave from the transmitter, through a sheet or members being fed (more exactly, the ultrasonic wave transmitted through the sheet or members), and the receiver outputs a signal corresponding to a reception level of the ultrasonic wave. When a level of the signal outputted from the receiver in the case of one sheet is compared with a level of the signal in the case of two or more number of sheets, the ultrasonic wave in the latter case is more attenuated than that in the former case, and hence the output level in the latter case is smaller than in the former case. For that reason, it is possible to judge whether or not the current sheet feeding is the doubles feeding by comparing the level of the output signal of the receiver is compared with a predetermined threshold level.

In the doubles detector of the phase type, the transmitter transmits a signal of a predetermined phase. The receiver receives a signal which is transmitted through a sheet or members. When a phase of the signal in the case of two or more sheet is compared with a phase of the signal in the case of one sheet, the phase of the signal varies more greatly in the former case than that in the latter case. For that reason, a doubles feeding may be detected by the utilization of the result of comparing a difference between the phases of the transmitting and receiving signals compared with a predetermined reference phase.

In the doubles detector of the level type, when the sheet is thin, its influence on the attenuation of the ultrasonic wave is small. Therefore, when the feeding of the one sheet is compared with the doubles feeding, a level difference between the receiving ultrasonic waves of the above two cases is not large. Therefore, the doubles detector has a disadvantage that it is very difficult to detect the doubles feeding in the case where the sheet is thin.

The doubles detector of the phase type has such a disadvantage that when the sheet is thick, the doubles detector of the phase type fails to detect the doubles feeding. More precisely, in a case where the sheet is thick, the attenuation of the ultrasonic wave is large. Therefore, in the case of the doubles feeding, the ultrasonic wave is greatly attenuated. As a result, a waveform of the ultrasonic wave is greatly deformed so as to fail to secure an S/N high enough to detect the periods of the ultrasonic wave, and the phase comparison becomes impossible.

Further, the phase type of the doubles detector has the following disadvantage. When surrounding temperature and atmospheric pressure vary, a propagation velocity of the ultrasonic wave also varies, thereby influencing a phase of the receiving signal. Therefore, the doubles detector cannot detect the doubles feeding correctly.

SUMMARY OF THE INVENTION

The present invention has been made in view of the above circumstances, and an object of the invention is to reliably detect the doubles feeding irrespective of the thickness of the sheet, and variations of surrounding temperature, atmospheric pressure and the like.

According to the present invention, there is a sheet detecting device comprising: transmitting means for transmitting a transmission signal; receiving means for receiving the transmission signal from the transmission means, through a feeding path through which a sheet is fed, and outputting a reception signal; generating means for generating a reference signal of a predetermined phase; phase comparing means for comparing a phase of the reception signal output from the receiving means with that of the reference signal generated by the generating means, and outputting a signal having a level corresponding to a phase difference therebetween; storing means for storing a predetermined reference level; and level comparing means for comparing an output of the phase comparing means with the reference level stored in the storing means, and outputting the result of the comparison.

In the thus constructed sheet detecting device, a transmission signal transmitted by the transmitting means is received by the receiving means, through a sheet. A phase of a reception signal output from the receiving means is compared with a phase of a reference signal, and a signal having a level corresponding to the phase difference is further compared with a predetermined reference level.

Before proceeding with the description of the present invention, description will first be given for clarifying the relationships of the means used in the description of the claim and the corresponding members or portions in the detailed description of the preferred embodiment. To this end, the technical features of the invention will be described in a manner that those means are attached with specific examples (one for each means) put in parentheses.

According to a first aspect of the present invention, there is provided a sheet detecting device comprising: transmitting means (e.g., ultrasonic-wave transmitter 1 in FIG. 1) for transmitting a transmission signal; receiving means (e.g., ultrasonic-wave receiver 2 in FIG. 1) for receiving the transmission signal from the transmission means, through a feeding path through which a sheet is fed, and outputting a reception signal; generating means (e.g., arithmetic operation unit 17 in FIG. 1) for generating a reference signal of a predetermined phase; phase comparing means (e.g., extracting unit 19 in FIG. 1) for comparing a phase of the reception signal output from the receiving means with that of the reference signal generated by the generating means, and outputting a signal having a level corresponding to a phase difference therebetween; storing means (e.g., threshold-value setter 20 in FIG. 1) for storing a predetermined reference level; and level comparing means (e.g., comparator 21 in FIG. 1) for comparing an output of the phase comparing means with the reference level stored in the storing means, and outputting the result of the comparison.

According to a second aspect of the present invention, in a sheet detecting device, the generating means includes a first holding means (e.g., phase holder 14 in FIG. 1) for causing a phase of the reception signal that is output from the receiving means when no sheet is present in the feeding path, to reflect on a phase of the reference signal.

According to a third aspect of the present invention, in a sheet detecting device, the generating means includes a second holding means (e.g., phase setter 15 in FIG. 1) for causing a phase of the reception signal, at a predetermined time, that is output from the receiving means when no sheet is present in the feeding path , to reflect on a phase of the reference signal, and a third holding means (e.g., phase setter 16 in FIG. 1) for causing a phase of the reception signal, at the predetermined time, that is output from the receiving means when one sheet is present in the feeding path, to reflect on a phase of the reference signal, wherein the generating means determines a phase of the reference signal in accordance with a difference between the sum of the phase stored in the first holding means and the phase stored in the third holding means, and the phase stored in the second holding means.

DETAILED DESCRIPTION OF THE PRESENT INVENTION

The present invention will be described in detail with reference to the accompanying drawings.

Figure 1:
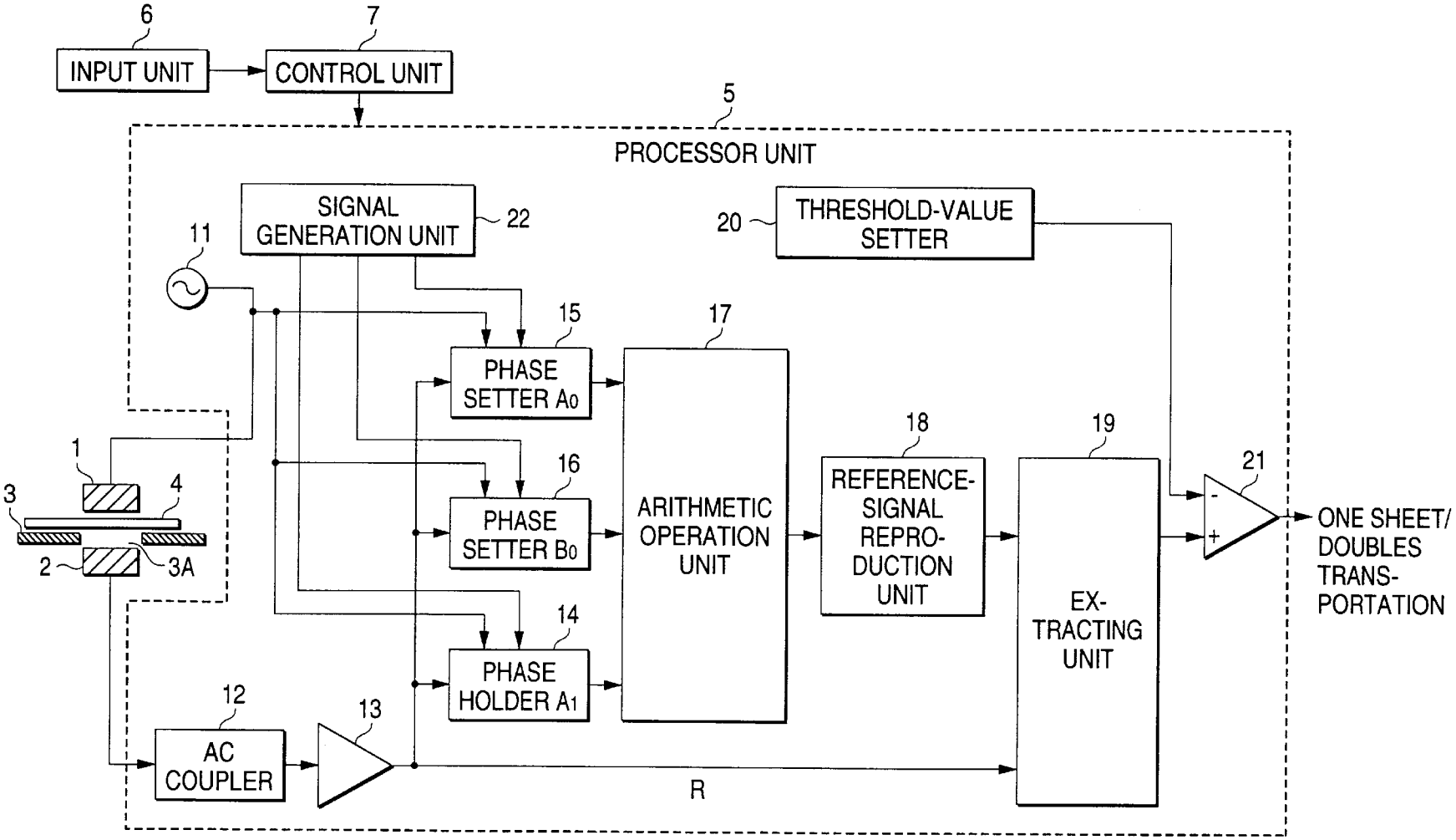
FIG. 1 is a block diagram showing an arrangement of a sheet detecting device of the present invention.

FIG. 1 is a block diagram showing an arrangement of a sheet detecting device of the present invention. An ultrasonic-wave transmitter 1 and an ultrasonic-wave receiver 2 are oppositely disposed with respect to a hole 3A of a feeding path 3. When a sheet 4 is being transmitted through the feeding path 3, the ultrasonic-wave receiver 2 receives an ultrasonic wave through the sheet 4 (the ultrasonic wave which is transmitted through the sheet) from the ultrasonic-wave transmitter 1. When a sheet 4 is not transmitted through the feeding path 3, the ultrasonic-wave receiver 2 directly receives the ultrasonic-wave receiver 2.

A processor unit 5 contains an oscillator 11, an oscillation signal outputted from the oscillator 11 is applied to the ultrasonic-wave transmitter 1, and in response to the oscillation signal the ultrasonic-wave transmitter 1 operates and generates an ultrasonic wave. A reception signal, which is output from the ultrasonic-wave receiver 2, is applied to the processor unit 5, an AC component of the reception signal is extracted by an AC coupler 12 formed with a capacitor, for example, and then amplified at a predetermined amplification degree by an amplifier 13. Thereafter, it is supplied to a phase holder 14, phase setters 15 and 16, and an extracting unit 19.

The phase holder 14, the phase setter 15 and the phase setter 16 sample and hold a phase of a signal output from the amplifier 13 in accordance with a sampling signal which is generated at predetermined timings under control of a control unit 7.

A sampling signal to be applied to the phase holder 14 is generated at such a timing that the sheet 4 is not present on the feeding path 3 just before the sheet detecting device is used. Accordingly, a phase A1 which is held by the phase holder 14 is based on temperature and atmospheric pressure at the time of using the sheet detecting device.

Similarly, a sampling signal is applied to the phase setter 15 so that the phase holder 14 holds a phase $A_0$ of a signal, which is output by the amplifier 13 when the sheet 4 is not fed onto the feeding path 3, for example, in factory before the products, or the sheet detecting devices, are delivered. Further, a sampling signal is applied to the phase setter 16 so that the phase holder 14 holds a phase $B_0$ of a signal, which is output by the amplifier 13 when one sheet 4 is present on the feeding path 3 in factory before the products are delivered.

An arithmetic operation unit 17 calculates a phase $B_1$ of a reference signal in accordance with the following equation by use of the output signals of the phase holder 14, the phase setter 15 and the phase setter 16.

$$B_1=B_0-A_0+A_1$$

A reference-signal reproduction unit 18 generates a reference signal in accordance with an output signal, e.g., a signal representative of digital data, for example, 6-bit, of the arithmetic operation unit 17, and outputs the reference signal to the extracting unit 19. The extracting unit 19 compares a phase of the signal received from the amplifier 13 with a phase of the reference signal received from the reference-signal reproduction unit 18, generates a signal at a level corresponding to a phase difference resulting from the comparison, and applies the signal to a non-inverting input terminal of a comparator 21. A predetermined threshold value, which is set in a threshold-value setter 20, has been input to an inverting input terminal of the comparator 21. The comparator 21 compares a level of the signal received from the extracting unit 19 with the predetermined threshold value from the threshold-value setter 20. When the signal level is larger than the threshold value, the comparator 21 produces a positive signal. When the signal level is smaller than the threshold value, the comparator 21 produces a negative signal.

The processor unit 5 thus arranged is controlled in its operation by the control unit 7 containing, e.g., a microcomputer. The control unit 7 controls the processor unit 5 in accordance with input signals derived from an input unit 6 containing various switches, buttons and the like.

Figure 2:
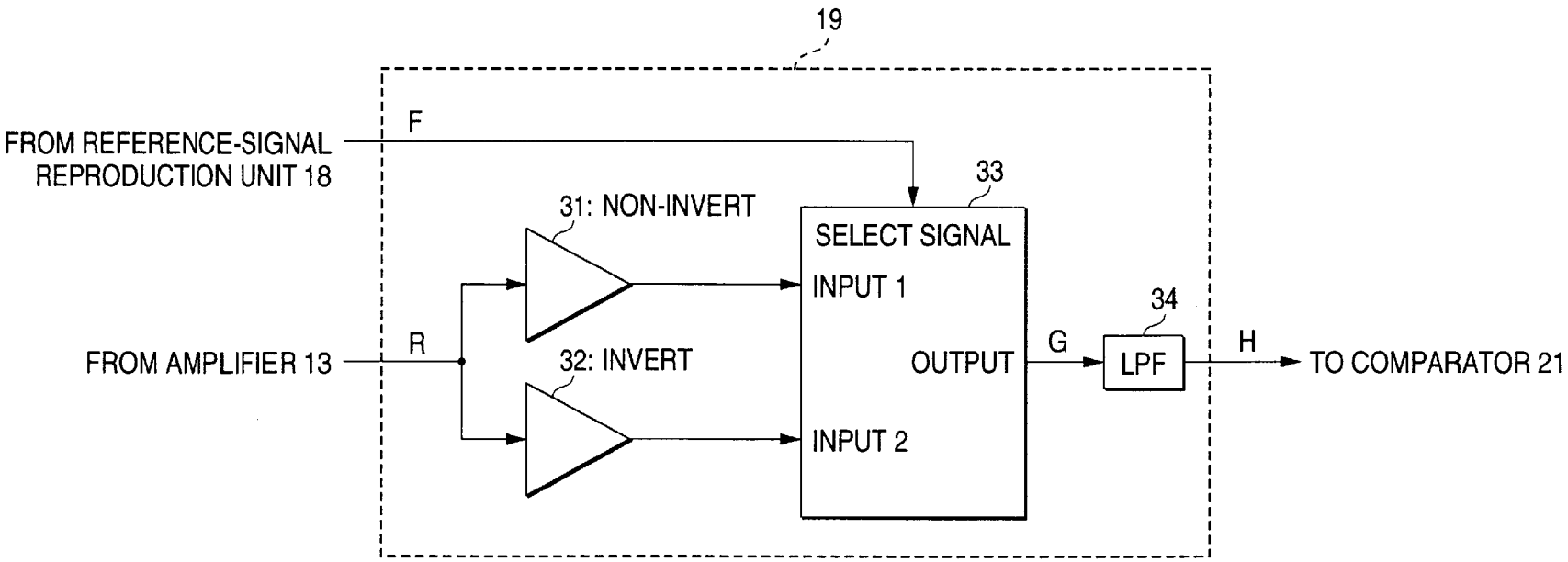
FIG. 2 is a block diagram showing an arrangement of an extracting unit 19 in the circuit of FIG. 1.

The extracting unit 19 may be arranged as shown in FIG. 2. A signal output from the amplifier 13 is input to a non-inverting amplifier 31 and an inverting amplifier 32. The non-inverting amplifier 31 amplifies a signal input thereto at a predetermined amplification degree while not changing the polarity of the input signal, and outputs the amplified signal to an input 1 of a selector 33. The inverting amplifier 32 inverts the polarity of a signal input thereto, amplifies the input signal at an amplification degree, which is equal to that of the non-inverting amplifier 31, and applies the amplified signal to an input 2 of the selector 33. When a reference signal received from the reference-signal reproduction unit 18 is positive in polarity, the selector 33 selects the signal input to the input 1 thereof and outputs the signal at the output terminal thereof. When the reference signal is negative, the selector 33 selects the signal input to the input 2 thereof and outputs the signal at the output terminal thereof. A low-pass filter 34 (LPF) 34 smoothes a signal received from the selector 33 and outputs the resultant signal to the comparator 21.

Figure 3:
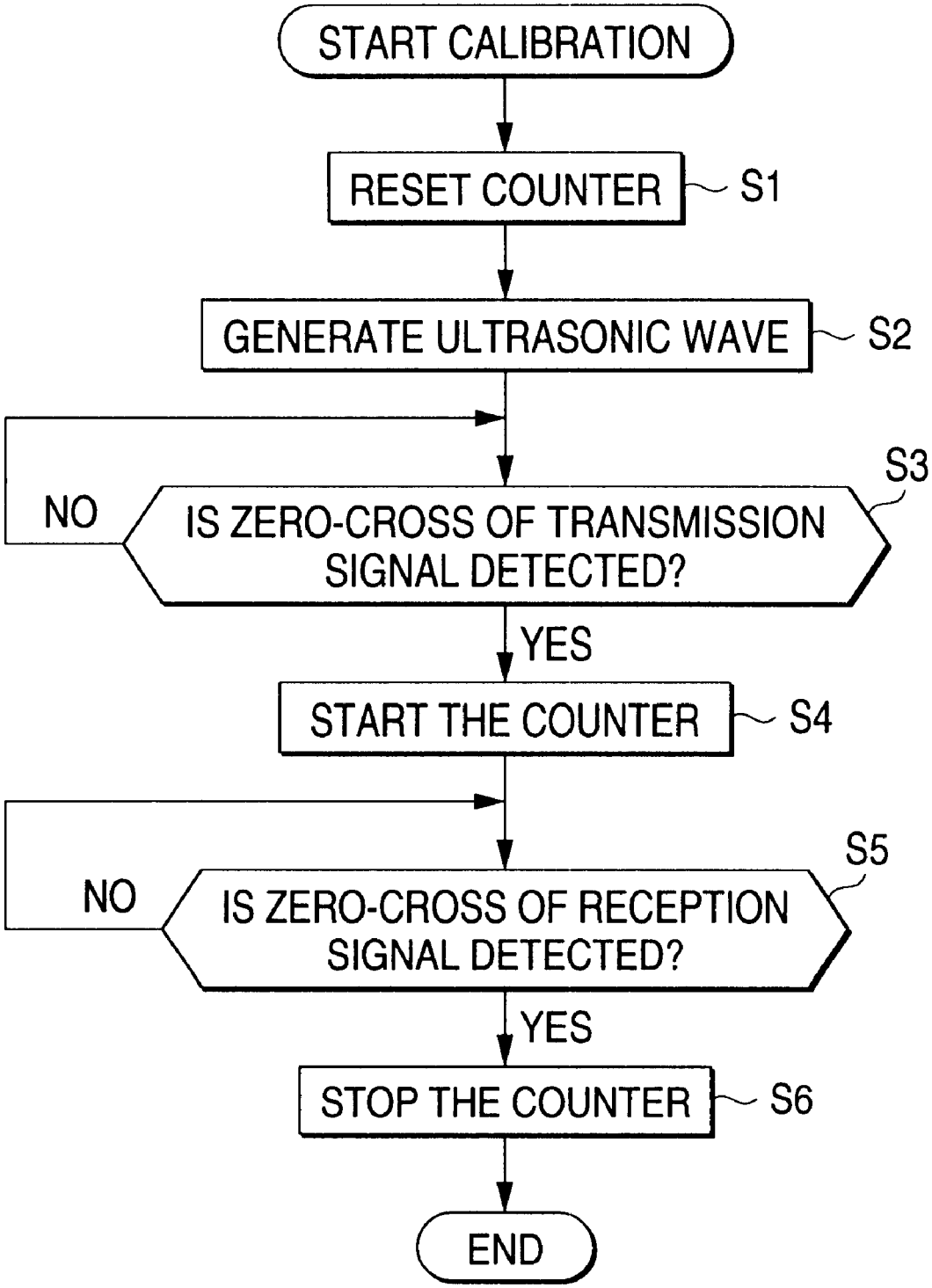
FIG. 3 is a flow chart showing a calibration process for a phase holder 14 in the circuit of FIG. 1.

An operation of the sheet detecting device will be described. When a user operates the input unit 6 and gives the sheet detecting device an instruction to start the device operation, the control unit 7 carries out a calibration process shown in a flow chart of FIG. 3. To start with, a step S1 is executed. In the step, the control unit 7 controls the phase holder 14, so that it resets a counter (not shown) contained therein. A step S2 is then executed. In the step, the control unit 7 controls the oscillator 11 to cause it to apply an oscillation signal to the ultrasonic-wave transmitter 1 and to cause the ultrasonic-wave transmitter 1 to generate an ultrasonic wave having a phase corresponding to the oscillation signal received from the oscillator 11. At this time, a sheet 4 is not yet fed to the feeding path 3. Accordingly, the ultrasonic wave transmitted from the ultrasonic-wave transmitter 1 is received by the ultrasonic-wave receiver 2 directly (not through the sheet 4).

When receiving the ultrasonic wave output from the ultrasonic-wave transmitter 1, the ultrasonic-wave receiver 2 outputs a reception signal corresponding to the ultrasonic wave. A DC component of the reception signal output is removed from the reception signal by the AC coupler 12, and only an AC component of the reception signal is amplified by the amplifier 13, and the resultant signal is applied to the phase holder 14.

The phase holder 14 has also received an oscillation signal from the oscillator 11. The phase holder 14, in a step S3, waits till a zero cross point of the oscillation signal (transmission signal) is detected. When the zero cross point is detected, the phase holder 14, in a step S4, starts the counter contained therein and causes it to start an operation of counting a clock signal.

The phase holder 14, in a step S5, waits till a zero cross point of the reception signal received from the amplifier 13. When the zero cross point is detected, the phase holder stops the counting operation of the counter, which was started in the step S4. The counter of the phase holder 14, in the step S4, starts an operation of counting a predetermined clock signal, and continues the counting operation till the counting operation is stopped in a step S6. As a result, a value corresponding to a time taken till the ultrasonic wave transmitted by the ultrasonic-wave transmitter 1 is directly received by the ultrasonic-wave receiver 2 is held in the counter of the phase holder 14. This time corresponds to a phase difference $A_1$ between the ultrasonic wave (transmission signal) that the ultrasonic-wave transmitter 1 transmitted and the reception signal received by the ultrasonic-wave receiver 1.

Through the calibration process mentioned above, a phase difference in ambient conditions, such as temperature and atmospheric pressure, when the sheet detecting device is used, is held in the phase holder 14.

A process similar to the above-mentioned calibration process is carried out in factory before the products are delivered (this calibration process will be referred to as a "factory calibration"). At this time, a phase difference $A_0$. created till an ultrasonic wave transmitted from the ultrasonic-wave transmitter 1 is received by the ultrasonic-wave receiver 2 is stored in advance in the phase setter 15. Further, in the factory calibration, a process similar to the above-mentioned calibration process is carried out in a state that a standard sheet is put on the feeding path 3, and a phase difference $B_0$ obtained through the process is held in the phase setter 16.

In this embodiment, the values of phase difference between the ultrasonic wave transmitted by the ultrasonic-wave transmitter 1 and that received by the ultrasonic-wave receiver 2 are held and set in the phase setters 15 and 16. In an alternative, the phase setters 15 and 16 may be formed with ROMs (read only memories). In this case, values empirically obtained by use of a standard sheet detecting device are stored into the memories.

The arithmetic operation unit 17 adds a value $B_0$ retained in the phase setter 16 and a value $A_1$ retained in the phase setter 15, and subtracts a value $A_0$ retained in the phase setter 15 from the result of the addition, thereby computing a phase $B_1$ of the reference signal. That is, the following equation is calculated $$B_1=B_0-A_0+A_1$$

Those values $B_0$, $A_0$, and $A_1$ are expressed in terms of digital data of 6 bits, and the arithmetic operation unit 17 digitally computes those data pieces.

The reference-signal reproduction unit 18 generates an analog reference signal corresponding to a reference phase expressed in terms of 6-bit digital data, and outputs it to the extracting unit 19.

The reference signal generated by the reference-signal reproduction unit 18 will be further described with reference to FIGS. 4A to 4F. Assuming that an oscillation signal that the oscillator 11 supplies to the ultrasonic-wave transmitter 1 is an oscillation signal shown in FIG. 4A, the phase setter 15 has retained a value $A_0$ corresponding to a phase delay of a reception signal at such a timing that the sheet 4 is not present on the feeding path 3 in factory before the products delivery. Similarly, the phase setter 16 has retained a value $B_0$ corresponding to a phase delay of a reception signal at such a timing that one sheet 4 is present on the feeding path 3 in factory before products delivery.

Figures 4A, 4B, 4C, 4D, 4E, 4F:
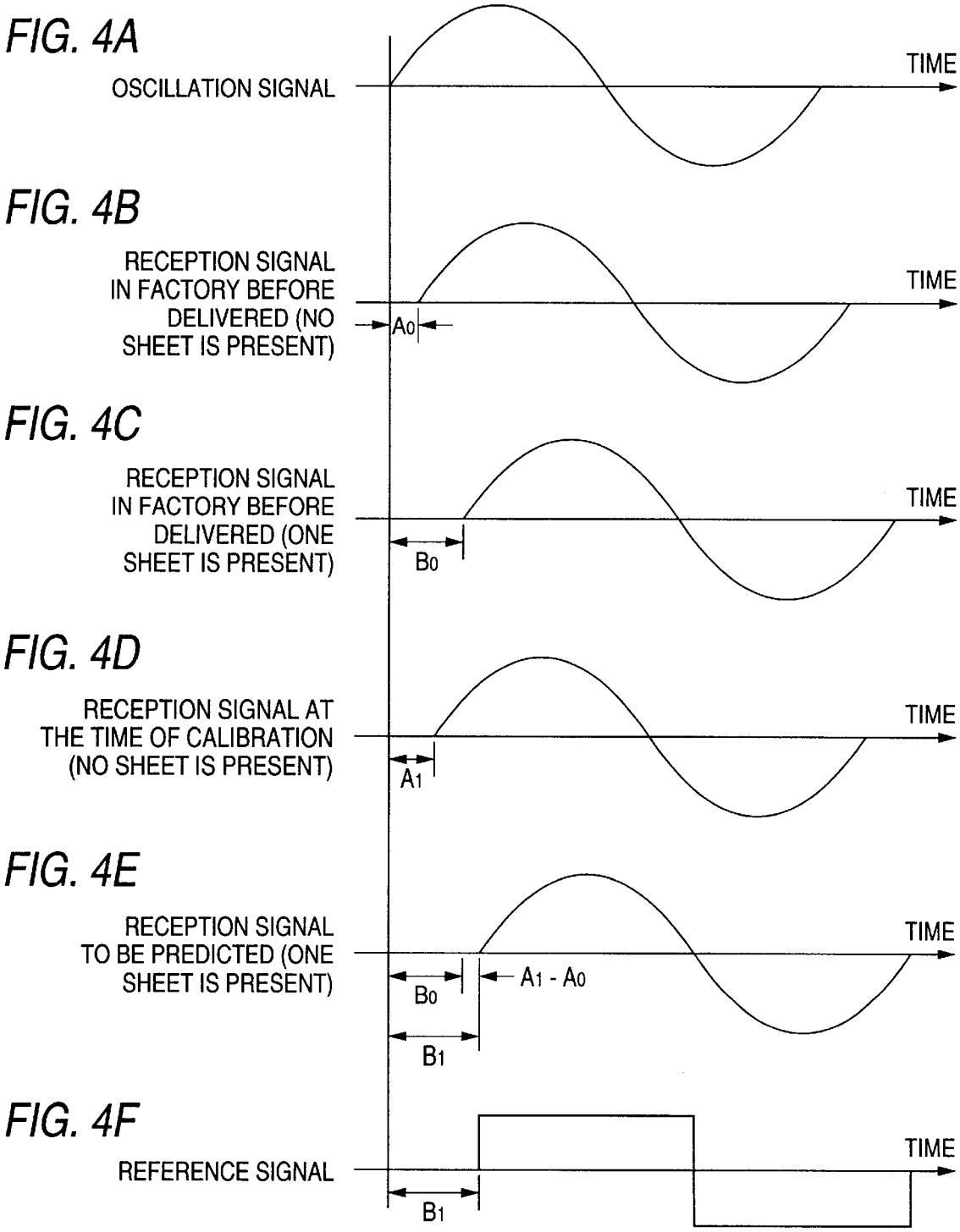
FIGS. 4A to 4F are waveforms useful in explaining an arithmetic operation by an arithmetic operation unit 17 in the circuit of FIG. 1.

Further, the phase holder 14 has retained a value $A_1$ corresponding to a phase delay of a reception signal of the ultrasonic-wave receiver 2 at such a timing that the sheet is not present when this device is used (at the time of calibration (referred to as a "user calibration"). There is a case where the value was $A_0$ in the factory calibration and it is $A_1$ in the user calibration. In this case, it may be considered that a difference ($A_1-A_0$) between those values is due to the fact that ambient conditions (temperature, atmospheric pressure and the like) in the factory calibration changed and are different from those in the user calibration. Therefore, since a delay value of the reception signal is $B_0$ when one sheet is present in factory before the products delivery, a phase delay of the reception signal when one sheet is present in the use of the device (in the user calibration) is estimated as $B_1$(= $B_0+A_1-A_0$) FIG. 4E is a graphical representation of a waveform of the estimated reception signal. The reference-signal reproduction unit 18 generates a reference signal of a rectangular waveform, which is delayed in phase behind the oscillation signal by the value $B_1(=B_0+A_1-A_0)$ as shown in FIG. 4F. This reference signal of the rectangular waveform corresponds to a reception signal having the phase delay $B_1$ which will appear in the case where one sheet is present on the feeding path 3 at the time of calibration.

Figures 5A, 5B, 5C, 5D:
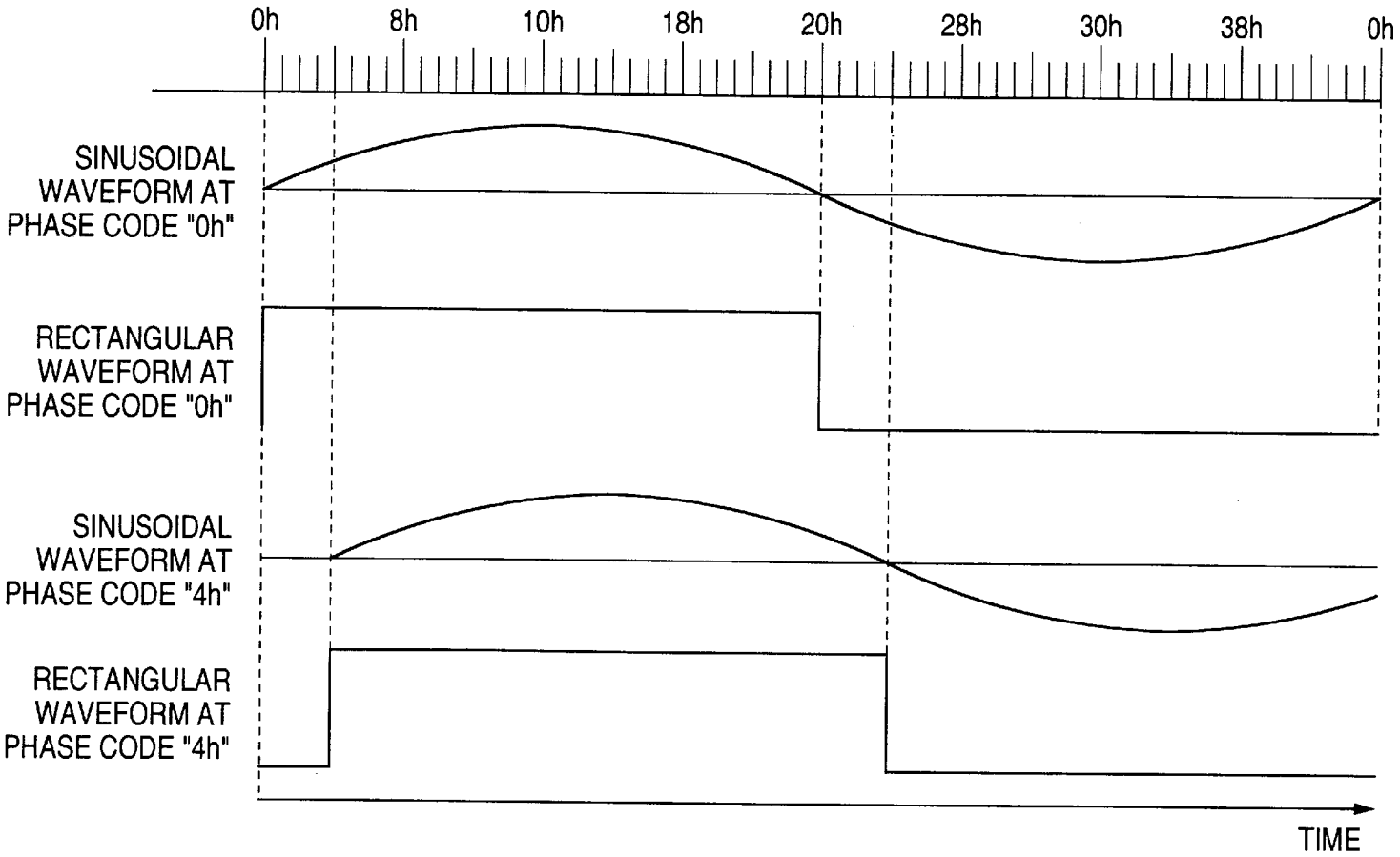
FIGS. 5A to 5D are waveform diagrams useful in explaining the principle of a reference-signal reproduction unit 18 in the circuit of FIG. 1.

The reference-signal reproduction unit 18 generates a rectangular wave signal of a predetermined phase, for example, as shown in FIGS. 5A to 5D. It is assumed that a time distance of $2\pi$ is divided into 64 segments, and 64 number of phase codes 00h to 3FH are assigned to those segments as shown in FIG. 5A. A rectangular wave at the segment the phase code 00h is as shown in FIG. 5B. A sinusoidal waveform at the segment of the phase code 04h, for example, is as shown in FIG. 5C, and a rectangular wave at the same phase code 04h is as shown in FIG. 5D. The reference-signal reproduction unit 18 converts a phase indicated by a counter value of 6 bits, which is supplied from the arithmetic operation unit 17, into a corresponding phase code, and generates a rectangular wave signal specified by the converted phase code.

After the calibration is thus performed, the control unit 7 controls a separation/feeding mechanism (not shown), so that the sheet 4 is separated and fed. At a time that the sheet 4 passes the hole 3A of the feeding path 3, the control unit 7 controls the oscillator 11, so that the ultrasonic-wave transmitter 1 generates an ultrasonic wave and the ultrasonic-wave receiver 2 receives the ultrasonic wave through a sheet 4. In turn, the ultrasonic-wave receiver 2 oautputs a reception signal corresponding to the received ultrasonic wave. The reception signal is input through the AC coupler 12 to the amplifier 13. And it is amplified by the amplifier 13 and then is input to the extracting unit 19. The reception signal passes through the non-inverting amplifier 31 and is input, as intact, to the input 1 of the selector 33. While at the same time it is input to the inverting amplifier 32 where it is inverted, and then is input to the input 2 of the selector.

FIGS. 6A to 6F are timing charts for explaining an operation of an extracting unit 19 in the circuit of FIG. 2.

Figures 6A, 6B, 6C, 6D, 6E, 6F:
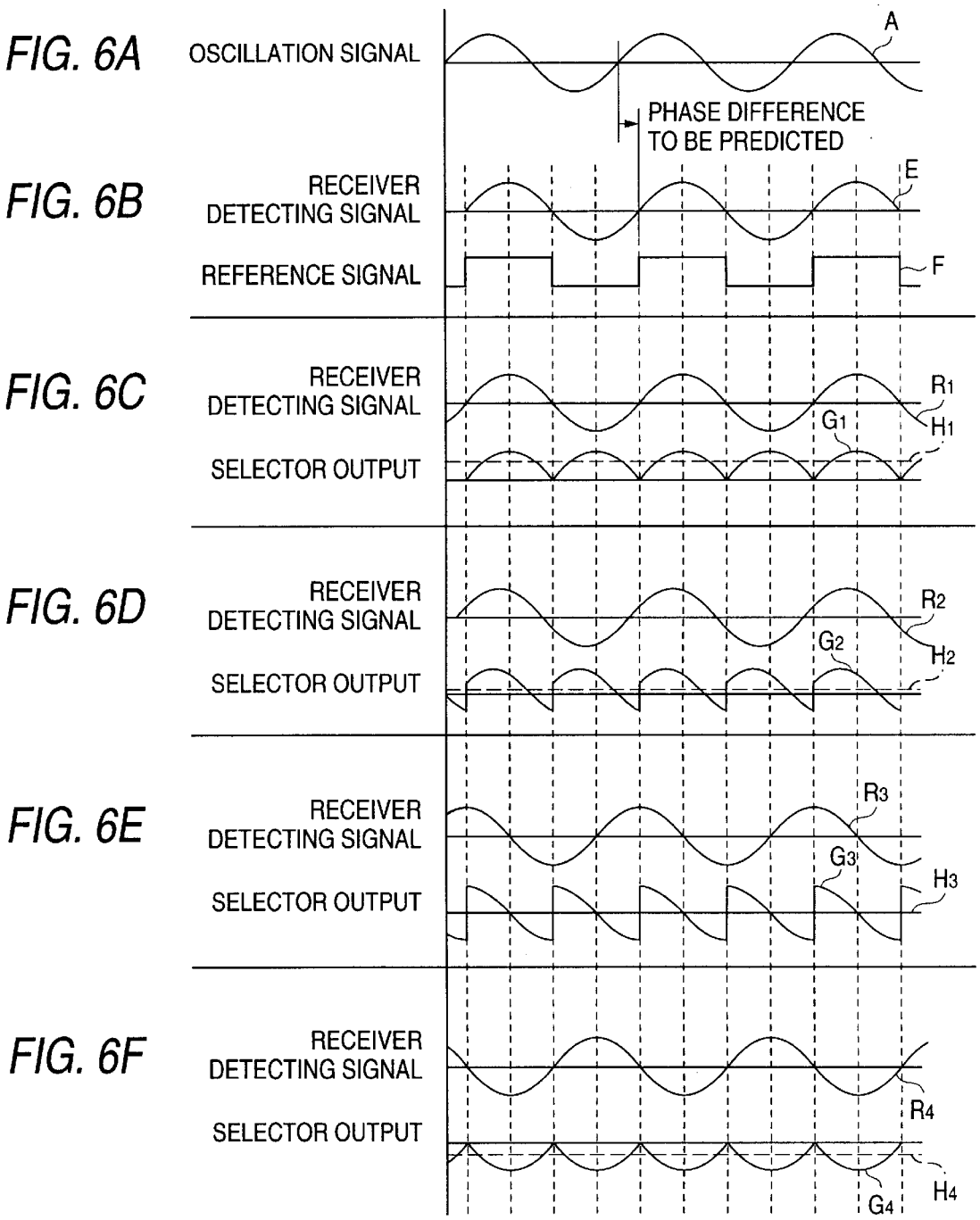
FIGS. 6A to 6F are timing charts for explaining an operation of an extracting unit 19 in the circuit of FIG. 2.

It is assumed now that a signal A of FIG. 6A (corresponding to the signal of FIG. 4A) is an oscillation signal, and a signal E of FIG. 6B (corresponding to the signal of FIG. 4E) is a reception signal which will appear in the case where one sheet is present. On this assumption, a reference signal output from the reference-signal reproduction unit 18 is a signal F in FIG. 6B (corresponding to the reception signal of FIG. 4F). In FIGS. 6C to 6D, the following cases are illustrated: a case where the reception signal is in phase with the reference signal (case 1, in FIG. 6C), another case where those signals are phase-shifted 30° (case 2, in FIG. 6D), still another case where those signals are phase-shifted 90° (case 3, in FIG. 6E), and yet another case where those signals are phase-shifted 180° (case 4, in FIG. 6F).

When the reference signal is logically high, the input 1 is selected by the selector 33, and when it is logically low, the input 2 is selected. Therefore, in the case where the reception signal is in phase with the reference signal (case 1), the selector 33 produces a signal G1 as formed by rectifying positive and negative half waves of a reception signal R1, as shown in FIG. 6C. Since the low-pass filter 34 smoothes the signal G1 as full wave rectified, it produces a signal H1 of a large level.

In the case where those signals are phase-shifted 30° (case 2), the selector 33 produces a signal G2 of a waveform containing not only positive portions of a reception signal R2 but also negative portions, as shown in FIG. 6D. As a result, a smoothing signal H2 of the low-pass filter 34 is positive in polarity and its level is lower than of the signal H1 in the case 1.

In the case where those signals are phase-shifted 90° (case 3), as shown in FIG. 6E, the selector 33 produces a signal G3 in which a ratio of the positive components of a reception signal R3 is equal to that of the negative components of the same. Therefore, a signal H3 output from the low-pass filter 34 is 0 in level.

In the case where those signals are phase-shifted 180° (case 4), the selector 33 produces a signal G4 having a waveform formed as by full-wave rectifying a reception signal R4 in the negative direction, as shown in FIG. 6F. Therefore, a signal H3 output from the low-pass filter 34 is negative in polarity.

As seen from the above description, a signal H output from the low-pass filter 34 of the extracting unit 19 becomes small with increase of a phase difference of the reception signal R from the reference signal R. Accordingly, when the signal H output from the low-pass filter 34 is compared in level with a predetermined threshold value set in the threshold-value setter 20 by the comparator 21, the comparison results are as follows: When the number of sheets 4 is 1, a phase delay of the reference signal is small. Accordingly, the output signal H of the low-pass filter 34 is higher in level than the predetermined threshold value. As a result, the comparator 21 produces a signal H of high level. When the sheets 4 are doubly fed, a phase delay of the reception signal is great. The output signal H of the low-pass filter 34 is lower in level than the predetermined threshold value set in the threshold-value setter 20. As a result, the comparator 21 produces a signal of low level.

The phase of the reception signal inevitably varies also in a case where the sheet 4 is thin. This embodiment converts the phase variations into levels, and compares the levels with the predetermined threshold value. Therefore, even if the sheet 4 is thin, the embodiment can detect the doubles feeding with certainty.

In a case where the sheet 4 is thick, the reception signal is reduced in level. Therefore, it is relatively difficult to detect the phase of the reception signal exactly. To cope with this, in the embodiment, the reception signals opposite in polarity are produced by use of the non-inverting amplifier 31 and the inverting amplifier 32. Both the signals are added together on the basis of the phase of the reference signal, and the resultant is converted into a level of a given analog signal by use of the low-pass filter 34. This is equivalent to the fact that the sheet is detected by the level type detection method. Therefore, the embodiment is able to detect the doubles feeding exactly.

A phase variation, which results from variations of ambient temperature and atmospheric pressure, is neutralized through the arithmetic operation by the arithmetic operation unit 17. In this respect, the sheet detecting device of the embodiment is capable of stably detecting the doubles feeding irrespective of ambient conditions in which the device is used.

As seen from the foregoing description, a sheet detecting device constructed according to the present invention compares the phases of a reception signal and reference signal, and compares a signal having a level corresponding to the phase difference with a reference level. Therefore, the sheet detecting device is capable of exactly detecting the doubles feeding irrespective of the thickness of the sheet and ambient conditions in which the device is used.

What is claimed is:

1. A sheet detecting device comprising:

transmitting means for transmitting a transmission signal;

receiving means for receiving the transmission signal from the transmission means, through a feeding path in which a sheet is fed, and the receiving means for outputting a reception signal;

phase comparing means for comparing a phase of the reception signal outputted from the receiving means with a predetermined reference phase, and the phase comparing means for outputting a signal having a level corresponding to a phase difference therebetween;

memory means for storing a predetermined reference level; and level comparing means for comparing the signal outputted from the phase comparing means with the reference level stored in the memory means, and the level comparing means for outputting a result of the comparison therebetween;

first storing means for storing a phase of the reception signal outputted from the receiving means when no sheet is present in the feeding path;

second storing means for storing at a predetermined time a phase of the reception signal outputted from the receiving means when no sheet is present in the feeding path; and third storing means for storing a phase of the reception signal outputted from the receiving means when one sheet is present in the feeding path, wherein the predetermined reference phase is determined in accordance with a difference between a sum of the phase stored in the first storing means and the phase stored in the third storing means, and the phase stored in the second storing means.

* * * * *